United States Patent [19]

Wada et al.

[11] Patent Number: 4,940,344

[45] Date of Patent: Jul. 10, 1990

[54] PRINTER HAVING A VARIABLE INTERVAL BETWEEN PRINTING AND CARRIAGE MOVEMENT

[75] Inventors: Toshihide Wada, Yokohama; Yuichi Watanabe, Kawasaki, both of Japan

[73] Assignee: Canon Kabushiki Kaisha, Tokyo, Japan

[21] Appl. No.: 303,953

[22] Filed: Jan. 31, 1989

Related U.S. Application Data

[63] Continuation of Ser. No. 51,177, May 18, 1987, abandoned, and a continuation of Ser. No. 754,439, Jul. 12, 1985, abandoned.

[30] Foreign Application Priority Data

Jul. 30, 1984 [JP] Japan ..... 59-159915
Jul. 31, 1984 [JP] Japan ..... 59-160334

[51] Int. Cl.[5] ..... B41J 1/22
[52] U.S. Cl. ..... 400/144.2; 400/157.2
[58] Field of Search ..... 400/144.2, 157.2, 157.3, 400/167; 101/93.02

[56] References Cited

U.S. PATENT DOCUMENTS

| | | | |
|---|---|---|---|
| 3,628,644 | 12/1971 | Cralle, Jr. et al. | 400/166 |
| 4,189,246 | 2/1980 | Kane et al. | 400/157.3 |
| 4,226,546 | 10/1980 | Hoffman | 400/157.3 |
| 4,232,975 | 11/1980 | Kane | 400/157.3 |
| 4,262,595 | 4/1981 | Araki | 400/157.3 |
| 4,493,570 | 1/1985 | Araki | 400/144.2 |
| 4,502,800 | 3/1985 | Jamieson et al. | 400/144.2 |
| 4,627,752 | 12/1986 | Yagi et al. | 400/144.2 |
| 4,710,043 | 12/1987 | Matsushita | 400/144.2 |

FOREIGN PATENT DOCUMENTS

| | | | |
|---|---|---|---|
| 58890 | 5/1981 | Japan | 400/157.3 |
| 165278 | 10/1982 | Japan | 400/166 |
| 67484 | 4/1983 | Japan | 400/166 |
| 69081 | 4/1983 | Japan | 400/166 |

OTHER PUBLICATIONS

Deetz, "Optimum Hammer Timing", Xerox Disclosure Journal, vol. 4, No. 2, pp. 155-156, Mar./Apr. 1979.
Deetz, "Variable Hammer Delay", Xerox Disclosure Journal, vol. 4, No. 2, pp. 157-158, Mar./Apr. 1979.
Westcott, "Print Hammer Settle Control", IBM Technical Disclosure Bulletin, vol. 24, No. 4, pp. 2131-2132, 9-81.

*Primary Examiner*—Edgar S. Burr
*Assistant Examiner*—Joseph R. Keating
*Attorney, Agent, or Firm*—Fitzpatrick, Cella, Harper & Scinto

[57] ABSTRACT

There is a printer comprising: a type wheel having a plurality of types; a type selecting apparatus for making the type wheel operative and thereby to lead the type selected from those types to a printing position; a signal generator to generate a striking signal to a printing hammer for making this selected type toward a printing paper; and a signal generator to generate a carriage moving signal to move a carriage on which the type wheel, type selecting apparatus and printing hammer are mounted. In this printer, the time intervals from the time of generation of the hammer driving signal until the time of generation of the carriage moving signal and until the time of generation of a wheel rotating signal are respectively changed with respect to the area of the individual type of the plurality of types. The time interval from the time of generation of the striking signal until the time of generation of the carriage moving signal is set on the basis of the time interval of generation of the striking signal which is set with regard to the individual type area.

6 Claims, 4 Drawing Sheets

PRINTER HAVING A VARIABLE INTERVAL BETWEEN PRINTING AND CARRIAGE MOVEMENT

This application is a continuation of application Ser. No. 051,177 filed May 18, 1987 and parent application Ser. No. 754,439 filed Jul. 12, 1985, both now abandoned.

BACKGROUND OF THE INVENTION

1. Field of the Invention

The present invention relates to a printer and, more particularly, to a printer in which a type wheel, a printing hammer and the like are mounted on a carriage and the type-printing is performed by striking types arranged around the type wheel due to the hitting operation of the printing hammer.

2. Description of the Prior Art

Hitherto, in such a kind of printer, the types arranged around the type wheel are struck toward a printing paper through an ink ribbon by way of the printing hammer. However, the type wheel, printing hammer, wheel driving motor, ink ribbon, etc. are mounted on the carriage, and the type wheel is rotated while it is moved to the next printing position by the carriage. Upon printing operation, the type wheel is held in the still state for the platen which holds the paper. After completion of the printing, the type wheel is again rotated for selection of the next type to be printed and is moved by the carriage.

On one hand, the optimum values of the hitting pressures of the types by the printing hammer differ in dependence on the size of the type areas. Therefore, in general, such a printer is provided with a table of the hitting pressures corresponding to the type areas and is constituted in such a manner that the hitting pressure is controlled so that the optimum hitting pressure is derived for every type by looking up this table. Since the mass of the hammer is constant, to obtain such an optimum hitting pressure, a current or the like is applied to a magnet coil in order to change the speed of the hammer to control the hitting force with which the hammer strikes the wheel.

However, in such a conventional printer, in the foregoing series of printing operations, a rotation start signal to rotate the type wheel and a movement start signal to move the carriage are output after the expiration of a constant still time, after upon completion of single printing operation. Thus, it is necessary to reduce the still time of the carriage and type wheel to be as short as possible in order to increase the printing speed.

SUMMARY OF THE INVENTION

It is an object of the present invention to solve the above-mentioned problems and to provide a printer in which the carriage movement start time is set in correspondence to the hitting pressure reference table of the printing hammer, thereby reducing the still time of the carriage and increasing the printing speed.

Another object of the invention is to solve the foregoing problems and to provide a printer in which: a carriage movement start time reference table corresponding to the hitting pressure reference table of the printing hammer is provided; the still time of the carriage is controlled by reference to this movement start time reference table so that it is reduced; the time of which a constant time was added to the movement start time which is derived from the movement start time reference table is set into the rotation start time of the type wheel; and two start times for the movement of the carriage and the rotation of the type wheel are controlled by way of a single time reference table, thereby increasing the printing speed.

DETAILED DESCRIPTION OF THE PREFERRED EMBODIMENTS

An embodiment of the present invention will now be described in detail hereinbelow with reference to the drawings.

Figure 1:
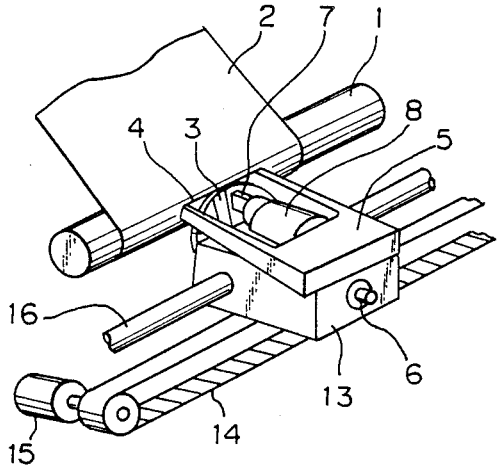
FIG. 1 is a perspective view showing outlines of a carriage driving section and a platen of a printer according to the present invention.
Figure 2:
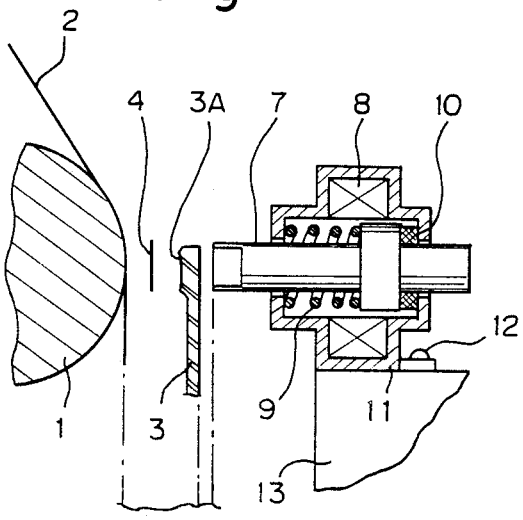
FIG. 2 is a diagrammatical view showing the relative positions of respective parts in a printing section of the printer according to the invention.

FIGS. 1 and 2 show one embodiment of the present invention. These diagrams mainly illustrate only the parts such as a carriage, a platen or the which are directly concerned with the printing operation. Illustrated in the diagrams are a platen 1; a printing paper 2 held by the platen 1; and a type wheel 3 having types 3A arranged at the points of radial arms. An ink ribbon 4 is supplied from an ink ribbon cassette 5 and is interposed between the paper 2 and the type 3A.

Further, a motor 6 is used to rotate the type wheel 3; a printing hammer 7 is used to strike the type 3A toward the paper 2 through the ink ribbon 4; and a magnetic coil 8 holds the printing hammer 7.

The printing hammer 7 can perform the striking operation due to the excitation of the magnetic coil 8.

A printing hammer return spring 9 is illustrated; an elastic shock absorber 10 is used to support the printing hammer 7 at the return position; and a hammer casing in which the coil 8, spring 9 and shock absorber 10 are enclosed is illustrated. The hammer casing 11 is attached to a carriage 13 through a screw 12. The type wheel 3, ribbon cassette 5 and hammer casing 11 are mounted on the carriage 13. This carriage is connected to a timing belt 14 and can be moved in the direction parallel to the platen 1 by way of a carriage driving motor 15. A numeral 16 is a guide axis for the carriage 13.

In the printer constituted as described above, the printing hammer 7 is energized by exciting the magnetic coil 8. The type 3A is struck toward the paper 2 together with the ribbon 4 due to the hitting force which is obtained at this time. After completion of the printing, the type wheel 3 and printing hammer 7 are returned to the original positions due to the repulsive force of the platen 1 and the spring force of the spring 9.

Figure 3:
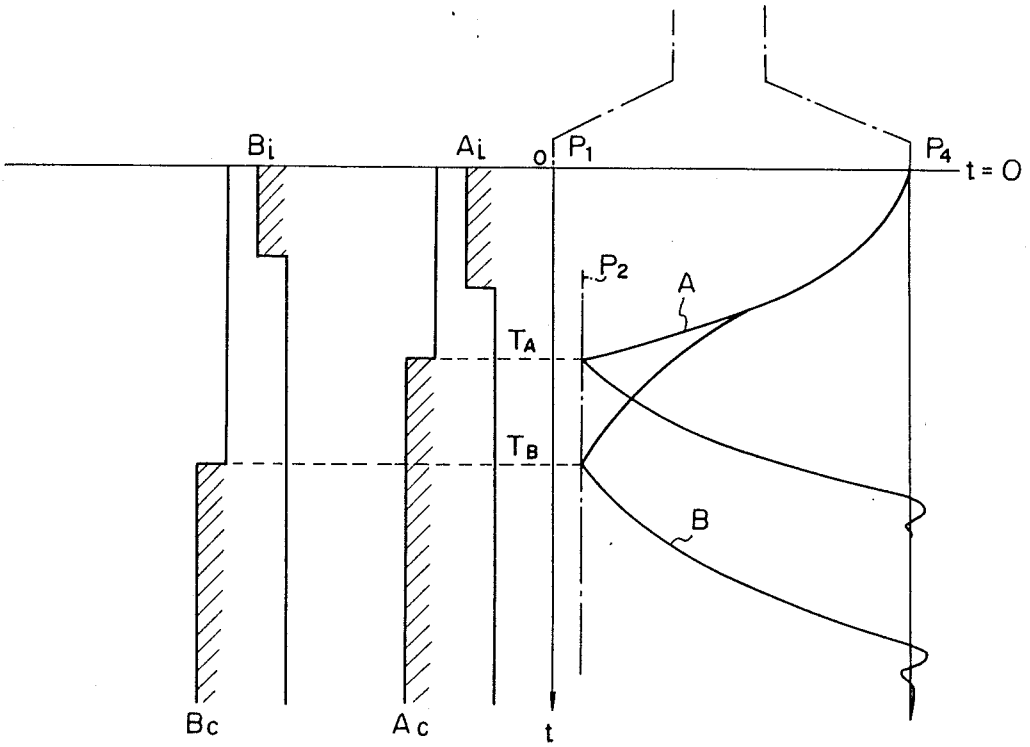
FIG. 3 is an explanatory diagram showing the relations among the operational locus of the point of a printing hammer in the printing section of the printer according to the invention and the output timings of a hammer drive electromagnetic coil driving signal, a carriage moving signal and a wheel rotating signal.

FIG. 3 shows the relations among the striking operation and returning operation of the printing hammer 7 in the printer of the present invention and the output timings when a carriage movement start signal and a wheel rotation start signal are generated. The right half portion in FIG. 3 corresponds to the positions in FIG. 2 for easy explanation.

That is, vertical lines $P_1$, $P_2$ and $P_4$ in the right half portion in FIG. 3 represent the surface of the platen 1, the final striking position of the type 3A, and the head position of the printing hammer 7. Therefore, the distance between the lines $P_1$ and $P_2$ is equal to the total dimension of the paper 2, the ribbon 4 and the thickness of the wheel in the portion of the type 3A.

Further, in the left half portion in FIG. 3, the time point immediately before the magnetic coil 8 is excited is indicated as an axis of abscissa of t=0. The output timings when an exciting signal of the magnetic coil 8, a carriage moving signal and a wheel rotating signal are generated are shown in the left lower portion of the axis of abscissa in accordance with the operation curve of the printing hammer in the right half in FIG. 3.

In FIG. 3, there are shown two kinds of cases where a magnet exciting signal $A_i$ is output for allowing the hammer 7 to generate a large striking force and where a magnet exciting signal $B_i$ is output for allowing the hammer 7 to generate a small striking force.

Practically speaking, when the exciting signal $A_i$ is output, the head of the hammer 7 operates in keeping with a locus such as indicated by a curve A. On one hand, when the exciting signal $B_i$ is output, the head of the hammer 7 operates on the basis of a locus such as shown by a curve B.

As will be apparent from the loci A and B, the time intervals until the head of the hammer 7 finishes the striking differ as indicated at $T_A$ and $T_B$. However, even if the carriage 13 is allowed to start moving at the respective times when these striking actions were completed, no trouble will be caused in the next printing operation. Therefore, in the present invention, carriage, moving signals $A_c$ and $B_c$ are generated at those times.

Although this embodiment relates to the case where two kinds of striking forces are derived, it is obviously possible to set such that various kinds of striking forces can be obtained in accordance with the size of the type area. In such a case, the timing when the carriage moving signal is generated may be set in a similar manner as above.

Next, the control means for realizing the foregoing operation times of the printing hammer and carriage will be explained with reference to FIG. 5.

Figure 5:
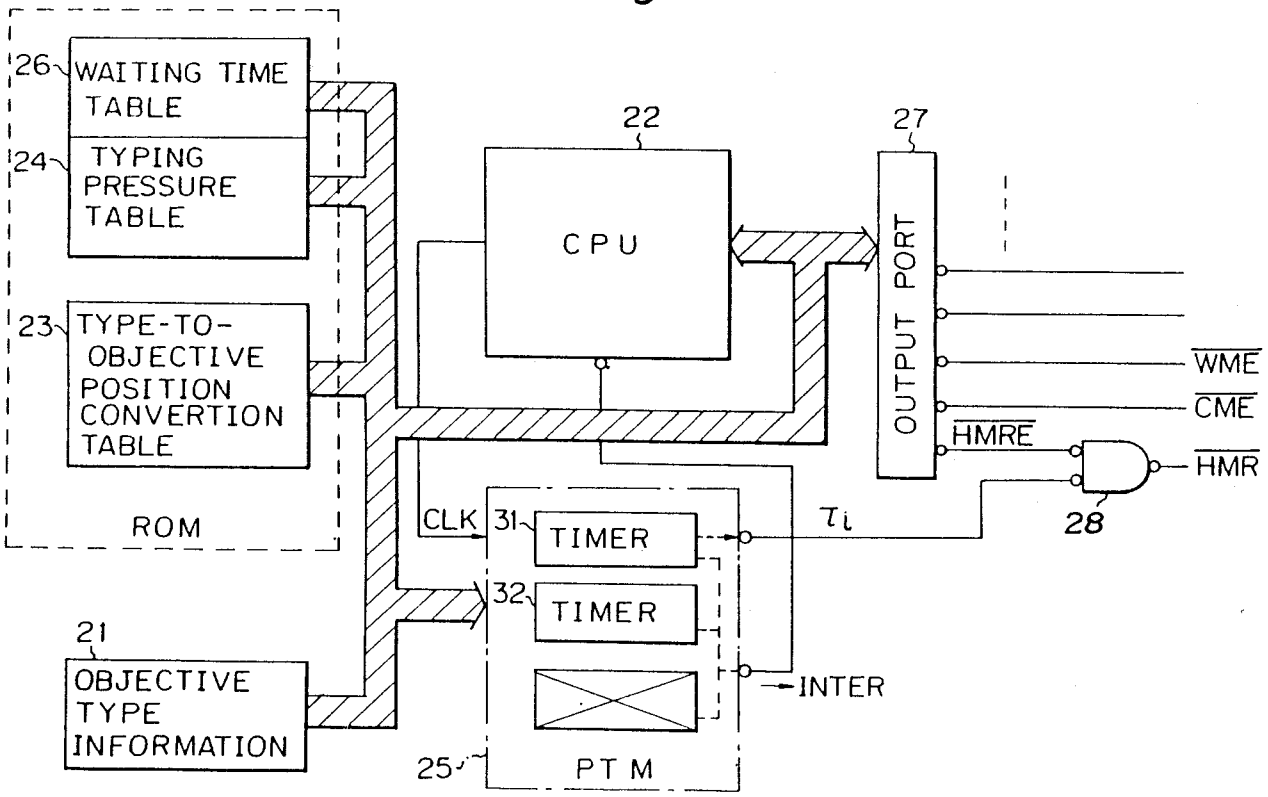
FIG. 5 is a block diagram showing one example of control means which is used in the printers of FIGS. 3 and 4.

In FIG. 5, objective type information 21 which was input from a keyboard or the like (not shown) and was converted to a parallel signal is stored into a memory in a CPU 22 for control of the printer. Thereafter, this information is temporarily converted to the objective position of the type wheel 3 by a type-to-objective position conversion table 23. Then, the CPU 22 performs the control to simultaneously advance the type wheel 3 and carriage 13 to the objective positions by way of a servo logic (not written here) by reference to a value in a typing pressure table 24 corresponding to the type objective position.

Next, when it is detected that the type wheel 3 and carriage reached the objective positions, the CPU 22 writes the value proportional to the exciting time of the printing hammer into a timer 31 in a program timer module (PTM) 25 for selecting the printing hammer exciting time corresponding to the reference value from the typing pressure table 24 and activates the printing hammer. In individual timers 31, 32, . . . in the PTM 25, the values written are sequentially subtracted in response to a clock signal CLK from the CPU 22 and when they become zero, the timers 31, 32, . . . generate an interruption signal to the CPU 22.

On the other hand, the CPU 22 also activates the timer 32 substantially simultaneously with the timer 31 by referring to the relevant value of a waiting time table 26 on the basis of the value referred from the typing pressure table. At this time, the value which is written into the timer 32 is set such that the relation of $$K\frac{1}{N} + m \ (k, m : \text{constants})$$

is satisfied when it is assumed that the value which is written into the timer 31 is N.

Reference characters k and m are constants which are determined in dependence upon the performance of the printing hammer 7. An output $\overline{HMRE}$ of an output port 27 is changed to "ON" simultaneously, with the carriage 13 and type wheel 3 reaching the objective positions. Thus, an output $\overline{HMR}$ of an OR gate 28 (a printing hammer driving signal, namely, magnet exciting signals $A_i$, $B_i$, . . . ) is set into the active state during an output time $T_i$ of the timer 31, so that the printing hammer 7 is driven.

On the other hand, the timer 32 which was activated almost simultaneously with the timer 31 becomes zero after an expiration of only the time of $$\left(K\frac{1}{N} + m\right) \times \text{(clock period)}$$

and generates an interruption signal to the CPU 22. In response to the interruption signal from the timer 32, the CPU 22 sets the carriage motor driving signal in the output port 27 into "ON" and starts the control to move the carriage 13 to the next type objective position. Therefore, when the exciting time of the magnetic coil 8 to drive the printing hammer 7 is long, the operation of the carriage 13 is rapidly started. On the contrary, when the exciting time is short, this operation becomes slower. In this way, the start of the operation of the carriage 13 is always made coincident with the point in time when the hammer 7 is finished striking. Consequently, unnecessary still time of the carriage is eliminated and a highly efficient printer can be realized.

As described above, according to the present invention, a printer having a carriage on which a type supporting member is mounted in which a type selected from the type supporting member is made operative with the force corresponding to the area of this type by way of striking means and thereby performing the printing is provided. In this printer, the time interval from the time of generation of the driving signal to the striking means until the time of generation of the carriage moving signal is changed relative to the time when the striking means is driven. Therefore, the minimum still time of the carriage can be achieved to reduce problems in the printing operation can be held, thereby increasing the printing speed.

Figure 4:
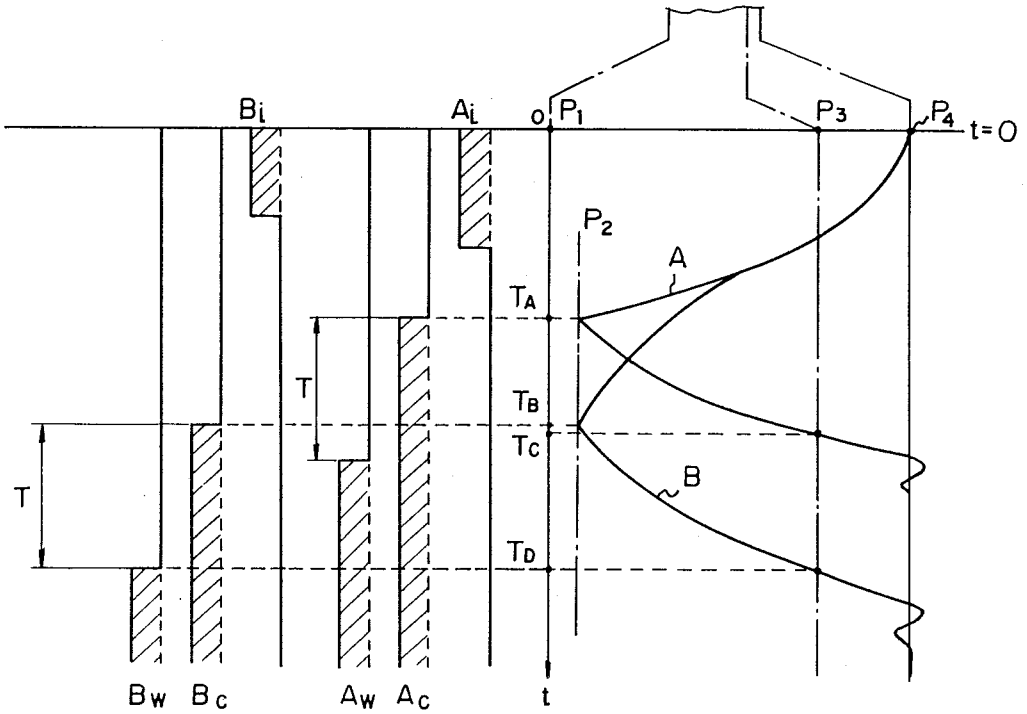
FIG. 4 is an explanatory diagram showing the relations among the operational locus of the point of the printing hammer in the printing section of another printer according to the present invention and the output timings of the hammer drive electromagnetic coil driving signal, carriage moving signal and wheel rotating signal.

FIG. 4 shows the relations among the hitting operation and returning operation of the printing hammer 7 in the printer of the present invention and the output times when the carriage moving signal and wheel rotating signal are output. The right half portion in FIG. 4 corresponds to the positions in FIG. 2 for easy understanding.

Practically speaking, the vertical lines $P_1$ to $P_4$ in the right half portion in FIG. 4 represent the surface of the platen 1, final hitting position of the type 3A, position of the rear surface of the type 3A, and head position of the printing hammer 7. Therefore, the distance between the lines $P_1$ and $P_2$ is equivalent to the total dimension of the paper 2, ribbon 4 and thickness of the wheel of the portion of the type 3A.

Further, in the left half portion in FIG. 4, the time point immediately before the excitation of the electromagnetic coil 8 is shown as an axis of abscissa of $t=0$. The output times when an exciting signal of the magnetic coil 8, a carriage moving signal and a wheel rotating signal are generated are shown in the lower left portion of the axis of abscissa in accordance with the operation curve of the printing hammer in the right half portion in FIG. 4.

FIG. 4 shows two cases where the magnet exciting signal $A_i$ is output for allowing the hammer 7 to generate a large striking force and where the magnet exciting signal $B_i$ is output for allowing the hammer 7 to generate a small striking force.

Practically speaking, when the exciting signal $A_i$ is output, the head of the hammer 7 operates in keeping with a locus such as shown by a curve A in FIG. 4. On one hand, when the exciting signal $B_i$ is output, the head of the hammer 7 operates as indicated by a locus of a curve B.

As will be obvious from the loci A and B as well, the time intervals until the head of the hammer 7 finishes striking differ as indicated at $T_A$ and $T_B$. However, even if the movement of the carriage 13 is started at respective time points when these striking actions were finished, no problems occur. Therefore, in this invention, the carriage moving signals $A_C$ and $B_C$ are generated at those times.

Further, as will be apparent from the right half portion in FIG. 4 as well, the time from the completion of the hitting by the head of the hammer until this head is returned to the position $P_3$ at the rear surface of the type is $T_C$ in case of the locus A, while it is $T_D$ in case of the locus B. Consequently, after those time points, no trouble will be caused in rotation of the type wheel 7.

In this embodiment, the time interval until the head of the hammer is returned from the line $P_2$ to the line $P_3$ in the locus B is longer than that in the locus A. Accordingly, in this embodiment, in accordance with the foregoing longer time interval, type wheel rotating signal $A_W$ or $B_W$ is output after an expiration of the time T after the carriage moving signal $A_C$ or $B_C$ was output as shown in the left half portion in FIG. 4.

Although this embodiment has been described with respect to the case where there are two kinds of magnet exciting signals of $A_i$ and $B_i$, they may be set to a plurality of kinds in dependence on the type areas. In such a case, the carriage movement start time table may be set in correspondence to those plurality of kinds in a similar manner as above. As the timing of generation of the type wheel rotating signal, the constant delay time T may be determined in accordance with the case where the returning time interval from the line $P_2$ to the line $P_3$ is longest among those plurality of cases.

Namely, since the timing of generation of the carriage moving signal and the timing of generation of the type wheel rotating signal are set with regard to the operation of the printing hammer as described above, the still times of the type wheel 7 and carriage can be reduced to the minimum times.

FIG. 5 shows an example of control means for controlling the operation timings for the printing hammer, carriage and type wheel according to the present invention in the manner as mentioned above.

The objective type information 21 which was input from a keyboard or the like (not shown) and was converted into the parallel signal is stored into the memory in the CPU 22 for control of the printer. Thereafter, this information is temporarily converted into the objective position of the type wheel 3 by way of the type-to-objective position conversion table 23. Next, the CPU 22 performs the control to simultaneously advance the type wheel 3 and carriage 13 shown in FIG. 1 to the objective positions by reference to the value in the typing pressure table 24 corresponding to the type objective position due to a well-known servo logic (not written here).

When it is then detected that the type wheel 3 and carriage 13 reached the objective positions, the CPU 22 writes the value proportional to the exciting time of the printing hammer into the timer 31 in the program timer module (PTM) 25 to select the printing hammer exciting time corresponding to the reference value from the typing pressure table 24 and activates the timer 31. In the individual timers 31, 32, . . . in the PTM 25, the values written are sequentially subtracted in response to the clock signal CLK from the CPU 22 and when they become zero, an interruption signal $\tau_i$ is generated to the CPU 22.

On the other hand, the CPU 22 also activates the timer 32 almost simultaneously with the timer 31 by reference to the relevant value of the waiting time table on the basis of the value referred from the typing pressure table. At this time, the value which is written into the timer 32 is set such that the relation of $$K\frac{1}{N} + m$$

is satisfied when it is assumed that the value which is written into the timer 31 is N.

Reference characters k and m are constants which are determined in dependence on the performance of the printing hammer 7. Since an output $\overline{HMRE}$ of the output port 27 is changed to "ON" simultaneously with the time that the carriage 13 and type wheel 3 reach the objective positions, an output $\overline{HMR}$ of the OR gate 28 (printing hammer driving signal, namely, magnet exciting signals $A_i$, $B_i$, . . . ) is set into the active state during the output time of $\tau_i$ of the timer 31, so that the printing hammer 7 is driven. On one hand, the timer 32 which was activated almost simultaneously with the timer 31 becomes zero after an expiration of only the time of $$\left(k\frac{1}{N}+m\right)\times \text{(clock period)}$$

and generates an interruption signal to the CPU 22. In response to an interruption signal from the timer 32, the CPU 22 sets the carriage motor driving signal in the output port 27 to "ON" and starts the control to move the carriage 13 to the next type objective position.

On one hand, immediately after the CPU 22 has once reset the timer 32 in response to the interruption signal of the timer 32, the CPU 22 again writes a constant C into the timer 32 and reactivates it.

The timer 32 becomes zero after an expiration of the constant timer T [T=C×(clock period)] and again generates an interruption signal to the CPU 22. In response to this interruption signal, the CPU 22 sets a type wheel motor driving signal WME in the output port 27 to "ON" and starts the control to rotate the type wheel 3 to the next objective position. Due to the foregoing series of processes, the printing hammer 7, carriage 13 and type wheel 3 can be allowed to continue the operations with a good time efficiency.

As described above, according to the present invention, a printer having a type wheel in which the time when printing hammer driving means is driven is varied in correspondence to the type area is provided. In this printer, the time interval from the time of generation of the driving signal to the hammer driving means until the time of generation of the carriage moving signal is changed relative to the type area, so that the minimum still time of the carriage such that no trouble is caused in the printing operation can be derived. Also, the type wheel rotating signal is output after an expiration of a predetermined limited time such that no problems occur in the rotating operation of the type wheel from the time generation of the carriage moving signal. Therefore, both of the carriage moving operation and the type wheel rotating operation can be easily controlled on the basis of the data regarding the type area, thereby enabling the speed in the continuous printing operation to be increased.

The application of the present invention is not limited to the foregoing kinds of printers. But, it is apparently possible that the invention can be widely and generally applied to any other printers in which the printing is performed while moving the carriage.

What is claimed is:

1. A printer comprising:

type supporting means for supporting a plurality of types;

type selection means for making said type supporting means operative to lead the type selected from among said plurality of types to a printing position;

a striking apparatus having a hammer for striking a type on a recording paper;

a carriage for mounting said type supporting member, said type selection means and said striking apparatus;

carriage moving means for moving said carriage between the printing positions and for providing a stop state at each one of the printing positions;

driving time means for supplying a driving time signal to said striking apparatus to make said hammer strike a type on a recording paper at a stop state of said carriage;

first timer means for counting, after said carriage is in the stop state, a length of time from a supply of a drive signal for hammer striking until a completion of striking of said type by a head of said hammer, said length of time being predetermined;

second time means for starting counting simultaneously with said counting by said first timer means to count a time until said carriage is to start moving after being in the stop state; and means for supplying, when a counting operation of said first timer means is completed, a carriage moving signal to said carriage moving means, the start time of the carriage moving signal being changed in accordance with an amount of a counted value of said second timer means.

2. A printer according to claim 1, further comprising a timer for counting the time represented by the driving time signal supplied from said driving time means.

3. A printer according to claim 1, further comprising print pressure memory means for respectively storing the driving time signals for said plurality of types.

4. A printer according to claim 3, further comprising memory means for storing impact times of said hammer which are equal to those represented by the respective driving time signals of said plurality of types, wherein said driving time means reads out an impact time from said memory means to supply to said timer means.

5. A printer comprising:

a type wheel having a plurality of types;

hammer means for striking said types;

carriage means having provision for mounting said type wheel and said hammer means;

first table means for storing hammer driving time data corresponding to said plurality of types;

first timer means for counting said hammer driving time data;

second table means for storing waiting time data which represents a waiting time while said carriage means waits at each printing position, the waiting time being determined based on said hammer driving time data;

second timer means for starting the counting of said waiting time data simultaneously with the start of counting by said first timer means;

carriage moving means for moving said carriage means between the printing positions and providing a waiting state at each one of the printing positions; and control means for placing said hammer driving time data into said first timer means to initiate said first timer means and for performing hammer striking of said hammer means when said first timer means counts to a first predetermined value represented by said hammer driving time data, and for placing said waiting time data into said second timer means to initiate said second timer means and for obtaining said waiting state of said carriage means when said second timer means counts to a second predetermined value represented by said waiting time data wherein said control means initiates said carriage means in response to count completion of said second timer means.

6. A printer according to claim 1, further comprising storage means for storing the time from the supply of the drive signal for hammer striking unit the completion of striking of said type by the head of said hammer.

* * * * *

UNITED STATES PATENT AND TRADEMARK OFFICE

CERTIFICATE OF CORRECTION

PATENT NO. : 4,940,344

DATED : July 10, 1990

INVENTOR(S) : Toshihide Wada, et al.

It is certified that error appears in the above-identified patent and that said Letters Patent is hereby corrected as shown below:

COLUMN 1:

Line 49, "after" should be deleted.

COLUMN 5:

Line 2, "can be held," should read --,--.

COLUMN 7:

Line 40, "time" should read --time of--.

Signed and Sealed this

Twenty-second Day of December, 1992

*Attest:*

DOUGLAS B. COMER

*Attesting Officer*

*Acting Commissioner of Patents and Trademarks*